United States Patent [19]

Suter

[11] Patent Number: 4,604,621

[45] Date of Patent: Aug. 5, 1986

[54] DEVICE FOR THE ELECTROMAGNETIC TRANSMISSION OF AN EVENT TAKING PLACE IN AN INTERFERENCE-LADEN ENVIRONMENT

[75] Inventor: Max Suter, Dotzigen, Switzerland

[73] Assignee: Omega Electronics S.A., Switzerland

[21] Appl. No.: 608,338

[22] Filed: May 9, 1984

[30] Foreign Application Priority Data

May 13, 1983 [FR] France ..... 83 08653

[51] Int. Cl.[4] ..... G08C 19/00; G08B 23/00; G04F 8/00

[52] U.S. Cl. ..... 340/825.69; 340/323 R; 368/1; 368/2; 368/6

[58] Field of Search ..... 340/825.69, 825.72, 340/323 R; 368/1, 2, 6, 46, 47; 273/86 R, 86 B; 377/5, 20; 272/4; 375/117

[56] References Cited

U.S. PATENT DOCUMENTS

| | | | |
|---|---|---|---|
| 3,789,653 | 2/1974 | Brejaud | 368/47 |
| 4,303,983 | 12/1981 | Chaborski | 377/20 |
| 4,368,987 | 1/1983 | Waters | 368/46 |

FOREIGN PATENT DOCUMENTS 183413 3/1966 U.S.S.R. .

*Primary Examiner*—Ulysses Weldon
*Assistant Examiner*—Ralph E. Smith
*Attorney, Agent, or Firm*—Griffin, Branigan & Butler

[57] ABSTRACT

The electromagnetic transmission in an interference-laden environment of events defined by the time of their occurrence is accomplished by repeatedly generating, at equal intervals after occurrence of the event, signals representing the occurrence of the event. An event which must be defined by the time $t_e$ at which it occurs triggers a switch which in turn triggers a time base whose signal is sent to a counter. The counter produces at its output a sequence of pulses which are coded in a coder. The code indicates for each pulse the deviation in time $\Delta T_i$ which separates it from the time at which the event occurred. The sequence of pulses is sent electromagnetically to a receiver via a transmitter. The first interference-free pulse received is processed by a decoder which provides the value $\Delta T_i$ to an arithmetic unit. The arithmetic unit subtracts the value $\Delta T_i$ from the time of day $t_h$ to obtain the time of day $t_e$ of the event. The device is applicable in particular to the timing of sporting events.

7 Claims, 4 Drawing Figures

DEVICE FOR THE ELECTROMAGNETIC TRANSMISSION OF AN EVENT TAKING PLACE IN AN INTERFERENCE-LADEN ENVIRONMENT

BACKGROUND OF THE INVENTION

The invention relates to a device for the electromagnetic transmission in an interference-laden environment of a sporting event, in particular an event entailing the start of a race involving several racers, said event being defined by the time $t_e$ at which it occurs.

When it is necessary to transmit events occurring at decentralized locations to a central management point, during races at sporting events for example, there are two generally known means used: transmission by cable or transmission by electromagnetic means.

An example of the first case is set forth in U.S. Pat. No. 4,156,870, in which the peripheral units are connected through an electronic module to a central control, operating and data processing unit through a single twin-strand cable. In the event there is a great distance separating the events to be measured from the central control point—ski races or practice races, for example—it may be advantageous to transmit the events in question by electromagnetic means (microwaves, light waves or infrared beams). This precludes the need to string long lines which, moreover, run the risk of accidentally being severed. Even on a course covering a relatively confined space, such a system may be advantageous because it eliminates considerable set-up and preparation time.

The radio link, known in and of itself, has disadvantages as well as advantages. In particular, it is affected by interference which may be of sufficient proportions to prevent the guaranteed transmission of the events. This refers in particular to atmospheric interference or interference from nearby transmitting equipment. These kinds of interference can prevent the transmission of a one-time event. It is readily understandable that if said event is characterized, for example, by the arrival time of a racer, as in sports timing, the times posted will be irrevocably lost.

To overcome this difficulty, it has been proposed to repeat the transmission of the message several times and for sufficiently long a period of time for its reception to be assured. In the event the message consists essentially of the time at which the event occurred, it will be repeated five, ten or twenty times, with the value always the same. If the word time is taken here to mean the time indicated by a master clock—which may be calibrated on the time of day provided by the standards service's clock, for example—at the loction where the event is taking place, it will be necessary to have an extremely precise time base if the aim is to measure the starting times of competitors in a race. Indeed, the time required to run a particular distance is determined by the difference existing between the starting time and the finishing time. It follows that each starting and finishing point will have to be equipped with extremely accurate clocks, synchronized as required.

An example will serve to clarify ideas. The lapse of time between the departure of the first racer and the arrival of the last racer in a given competition is, let us suppose, two hours. During these two hours, it is desired that the time shown by the clock at the starting point and the time indicated by the clock at the finish line diverge by no more than one thousandth of a second. Under these conditions, the precision required of each clock will be $0.001 \times 24/2 = 0.012$ second per day. Such a degree of precision can be attained only by a sophisticated and expensive device which, moreover, will have to be stabilized at a temperature range of $-20$ to $+60$ degrees Celsius.

Certificate SU-A-183,413 proposes to improve the sureness of radio transmission of the instant at which a charge used in seismic research is fired off. The system is based on the transmission of signals triggered by the charge and coded in series, with the coding changing each second. Thus, when one of the signals is received correctly, the instant of firing can be evaluated.

Apart from the fact that the said document does not mention how the use of such a system might be applied to sports racing chronometry, it also does not consider or suggest that the coded signals are arranged in such a way as to provide, in addition to the indications which situate them in time vis-a-vis the event, indications whereby it is possible to identify each racer taking part in the competition. Furthermore, in the last paragraph of Column 1 of the said document, it is stipulated that the generator 1 shown in FIG. 1 is quartz stabilized, indicating that in this system it is the transmitter which contains the time base and not the receiver (see also the last paragraph of Column 3), quite contrary to what will be described in the present invention in which the transmitter has only a relatively imprecise oscillator and it is the receiver that contains a precision time base.

While the present invention is also based on the idea of the repeated transmission of events, it proposes to overcome the above-mentioned drawbacks.

SUMMARY OF THE INVENTION

An object of the present invention is to provide a method and apparatus for transmitting data relating to the time of occurrence of events, the transmission being accomplished electromagnetically in an environment wherein interference may be present.

In accordance with the principles of the present invention the occurrence of an event causes pulses to be applied to a counter which counts the pulses and produces a sequence of signals each separated from the next by a fixed interval of time. The sequence of signals is fed to an encoder where an identifying sign or serial number is assigned to each signal of the sequence. The signals and their identifying signs are then electromagnetically transmitted to a receiver station where a decoder detects the first signal of the sequence which has not been lost by interference. The identifying sign of this signal is then used to assign to the signal an interval value $\Delta T_i$. An arithmetic unit then subtracts $\Delta T_i$ from a value $t_h$ obtained from a precise clock at the receiver station to derive $t_e$ which represents the time of occurrence of the event.

The invention will be understood more readily in the light of the following description, which is provided by way of example and illustrated by the accompanying drawings.

DETAILED DESCRIPTION OF THE INVENTION

Figure 1:
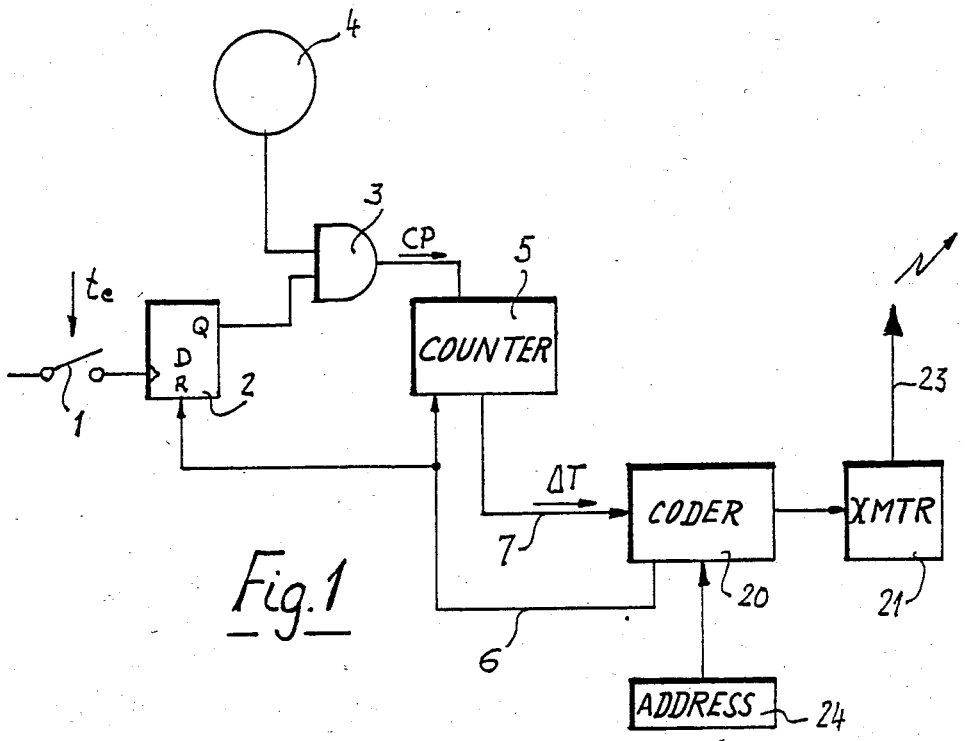
FIG. 1. is a block diagram of an events transmitter according to the invention.

FIG. 1 is a block diagram of a transmitter constructed in accordance with the principles of the present invention. The transmitter is generally located near the event, which, when it occurs at the time $t_e$ that must be determined, closes a switch 1. As many transmitters are provided as there are measuring points. In the case of a sporting competition at least the starting line and finish line will be equipped with such a device. The switch 1 may be in the form of a light barrier or an electromechanical gate. The electrical pulse given off by the switch 1 triggers a flip-flop 2, which then provides a logic 1 level signal at its output Q. An AND gate 3 receives, at a first input, clock pulse signals from a time base 4, and at a second input, the signal from output Q of flip-flop 2, so that the signal from the time base 4 may pass through the AND gate 3 when the output Q is at the logic 1 level. The clock pulses CP from the time base 4 and present at the output of the AND gate are applied to a counter 5. The counter 5 produces at its output 7 a second set of pulses spaced apart from each other by predetermined and equal intervals $\Delta T_i$ determined by the counting modules of counter 5. Thus these second pulses constitute a repetition of the first pulse, triggered by the event, and are defined in time by the intervals $\Delta T_1$, $\Delta T_2$, . . . $\Delta T_i$, . . . $\Delta T_n$ which separate them from the first pulse.

In a practical example, the time base frequency selected is 10 kHz. The first of the second set of pulses which follow the triggering pulse is spaced one tenth of a second from the latter. The second pulses are likewise separated by intervals of one tenth of a second. In this case, at its output 7 the counter 5 will give off one pulse for every 1,000 received at its CP input. In this example, therefore, the event which occurred upon the closing of the switch 1 will be repeated every tenth of a second. Since experience shows that electromagnetic interference lasts only several tenths of a second, it is likely that during a one-second transmission at least one of the ten pulses emitted will be picked up by the receiver. In the example selected, therefore, after the transmitter has transmitted ten pulses, it will generate a reset-to-zero signal through line 6 and this signal will counter itself and the flip-flop 2. Accordingly, output Q will revert to zero and will close the AND gate 3.

Figure 3:
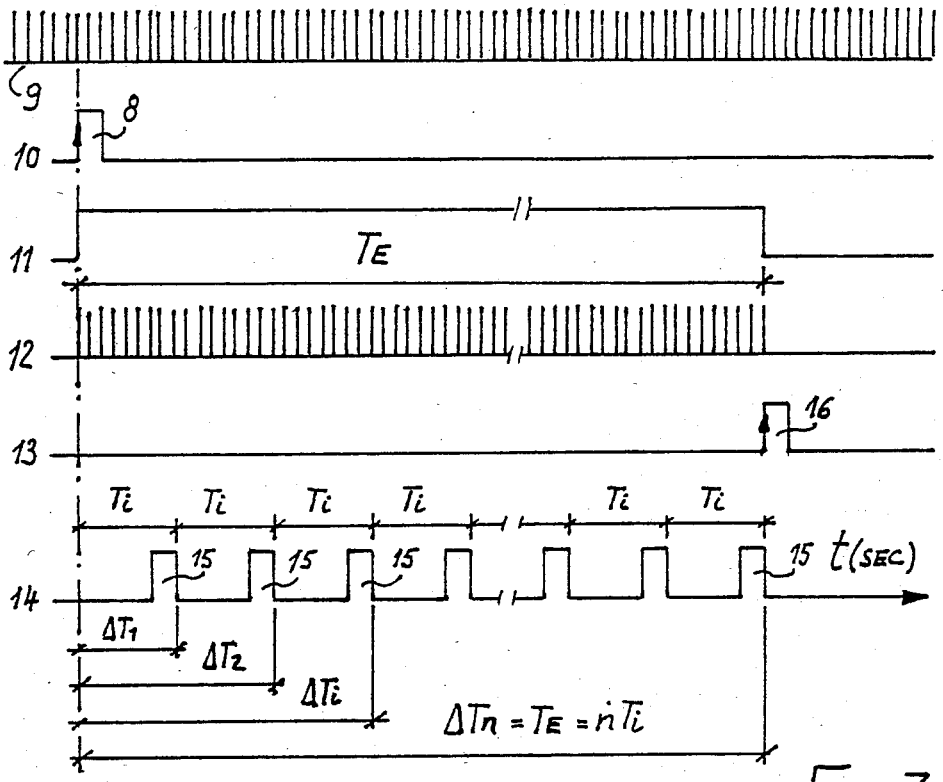
FIG. 3 is a timing diagram showing the pulses transmitted by the transmitter, and which shows how said pulses are shaped.

The diagram in FIG. 3 provides a graphic explanation of how the above-described process is organized. The signals from the time base 4 are represented on line 9 of the diagram. The event which closes switch 1 is represented by the rising side of pulse 8 represented on line 10 of the diagram. At this time, the output Q of flip-flop 2 goes to the logic 1 level and holds for a predetermined period $T_E$, which is shown on line 11 of the diagram. The pulses from the time base 4 then pass through the AND gate 3 and are represented on line 12. The pulses on line 12 and the logic 1 level at the output Q of flip-flop 2, shown on line 11, are maintained until the occurrence of the rising side of pulse 16 (represented on line 13), which is the reset-to-zero signal produced by the counter on line 6 of FIG. 1. The counter 5 counts the pulses shown on line 12 and the counter includes gating or decoding circuits so that it produces pulses 15 at its output 7. The pulses at output 7 occur at predetermined and equal intervals $T_i$, so as to obtain the ultimate calculation $T_E = n \times T_i$ as shown on line 14.

As the transmission channel is assumed to be affected by parasite signals, it is clear that upon receipt of the signal of line 14, one or more pulses 15 may be missing, making a receiver incapable of determining whether the first pulse received is the one occurring at $\Delta T_1$ or at $\Delta T_2$ or at $\Delta T_i$ after the signal given off by the event. It is therefore necessary to give each pulse 15 a distinctive sign making it possible to situate it in time with respect to the event. This is done by means of a coder 20 represented in FIG. 1. This coder will, for example, provide each pulse 15 received at its input with a serial number in a binary code. This is realized very simply by means of a divide by 10 arrangement comprising four flip-flops providing a parallel binary code available on four conductors. Coder 20 further includes a UART circuit (universal asynchronous receiver transmitter), for example RCA 1854 which transforms the parallel coded signal from the divide by 10 into a series coded signal. This identification of each pulse makes it possible to determine what time interval $\Delta T_i$ separates it from the rising slope of the first pulse 8 triggered by the event. The output of the coder 20 includes not only the sequence of pulses 15, but also the time intervals $\Delta T_i$ (represented by the serial numbers) which make it possible, as will be shown later, to assign a time $t_e$ to the event which has just occurred. It bears noting that other systems could be selected to distinguish between each of the pulses 15. For example, each of the pulses could have a different amplitude, or they could each be assigned a different low frequency signal.

The transmitter device in FIG. 1 is further complemented by a transmitting system 21 whose carrier frequency is covered by the antenna 23. Note that the carrier frequency is generally in the bands in the 180 to 470 MHz range, or even in the "citizen's band" (27 MHz). The carrier frequency is modulated by the signal given off by the coder 20.

Stress has so far been laid on the transmission of events defined at least by the time at which they occur. It could happen, however, that this transmission could be used to good advantage in order to add other data to the pulses transmitted, such as for example the number on the racer's jersey and his location (start, intermediate point, finish line). It is thus possible to add an addressing device 24, which could be a keyboard from which the data are transmitted to the coder 20.

Figure 2:
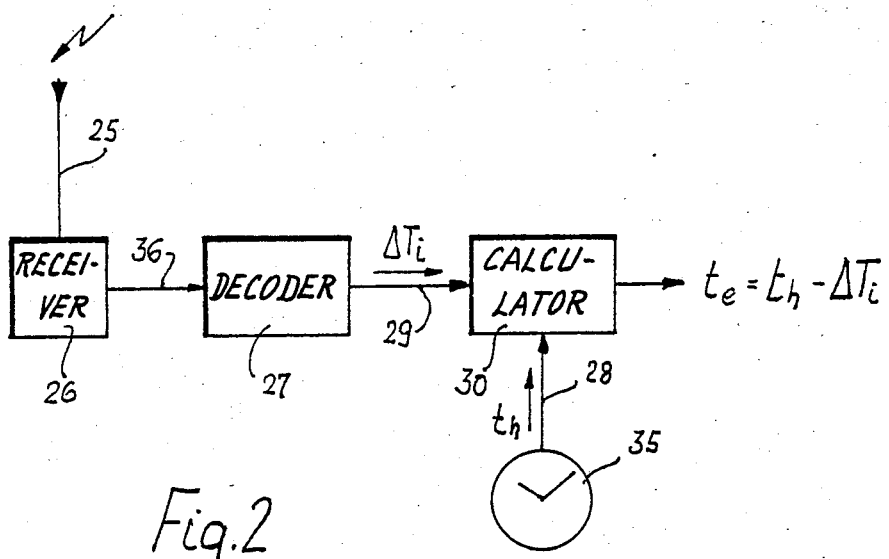
FIG. 2 is a block diagram of the receiver for events transmitted by the transmitter of FIG. 1.

FIG. 2 is a circuit diagram illustrating a receiver for receiving the signals transmitted by the transmitter shown in FIG. 1. The electromagnetic waves from transmitter antenna 23 are picked up by the receiving antenna 25 and fed to the receiver 26, which produces a demolutated signal at its output 36. This signal is applied to a decoder 27 which selects from among all the signals received the first pulse not affected by interference (and hence containing complete data) and assigns to the pulse an interval value $T_i$ in response to the distinctive sign borne by that pulse. This value is transmitted to a calculation unit 30 via line 29. The decoder 27 may be a UART circuit as already mentioned. In addition, arrangements are made to preclude the transmission of other interval values which might follow the first one considered valid. The same calculation unit 30 receives, via line 28, the signal from a master clock 35, which for example provides the current time of day $t_h$. Knowing now at what time of day $t_h$ the time interval $\Delta T_1$ was transmitted, it is possible to calculate the time of day $t_e$ at which the event occurred by having the calculation unit perform the following subtraction:

$$t_e = t_h - \Delta T_i.$$

The initial important advantage which may be obtained from the device just described is that of guaranteeing perfect certainty of transmission of the event, which, it will be recalled, occurs only once. Thus the repetition of the data resulting from the event will make it possible for at least one of the transmitted pulses to reach the receiver, and the pulse will indicate, after decoding, the precise time of day of the event.

A second and no less important advantage is the use of equipment which is considerably less sophisticated and hence less expensive, which will be explained below.

Unlike the current methods described in the opening observations, in which transmitting the time of day directly from clocks placed at the site of the event was contemplated, the system just described according to the invention brings into play only one precision clock, located at the receiving post, for all the events recorded by the peripheral transmitting units. Here, each of the transmitting units is equipped with a time base which need not be all that precise.

To take but one example, we will use a simple quartz oscillator not corrected for temperature as the time base 4 (see FIG. 1). Such an oscillator is quite inexpensive and has a maximum inaccuracy of roughly 100 seconds per day. In the example cited above, it was explained that the transmission time for an event may last approximately one second. If in the course of one day (86,400) seconds) the deviation of the oscillator is 100 seconds, the same deviation will be only 100/86,400 or 0.0012 second over the one-second period concerned. Thus if the first valid pulse received by the receiver is the tenth in a sequence of pulses spaced a tenth of a second apart, the error introduced will not exceed a thousandth of a second. This error will decrease, of course, if the pulse taken into account is earlier than the tenth one.

It is hence clear that the repeated transmission of an event by means of pulses which bear a reference for the gap separating them from the event itself not only ensures a fully secure transmission but also makes it possible to use inexpensive equipment. While the use of such a device is particularly advantageous for the timing of sporting events, it is obvious that its use could be considered for any occasion requiring the identification of any event in terms of time.

Figure 4:
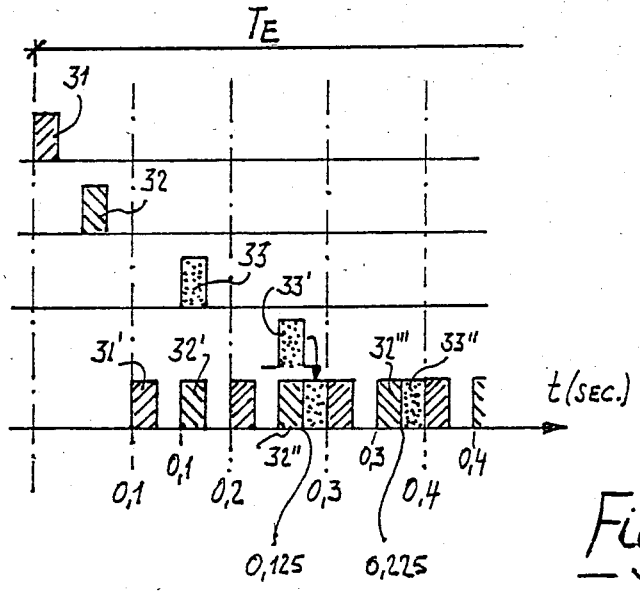
FIG. 4 is a timing diagram for a second embodiment wherein several events are transmitted from a single transmitter.

It also bears noting that during the predetermined period $T_E$ it would be possible to transmit several events instead of just one. This situation is shown in FIG. 4. Here, events 31, 32 and 33 are repeated in the same way as described above. To avoid possible overlapping, it is arranged to lag the repeat pulses in relation to one another. In the example shown in the diagram, it is obvious that if no precautions were taken and each of the three events were to recur every tenth of a second, the second repetition of event 32 (=32″) would coincide with the first repetition of event 33 (=33′). To overcome this problem, event 33 has not been repeated for the first time until 0.125 second after its occurrence. This naturally requires additional coding and decoding, but poses no difficulties if the general idea set forth in this invention is adhered to.

While a specific preferred embodiment of the invention has been described in specific detail it will be understood that various substitutions and modifications may be made in the described embodiment without departing from the spirit and scope of the invention as defined in the appended claims.

I claim:

1. A device for electromagnetically transmitting, in an environment marked by interference, a sporting event entailing in particular the start of a race in which several racers are involved, said event being defined by a time $t_e$ at which it occurred, characterized by the fact that the device consists of a transmitting mechanism able to transmit a sequence of pulses consecutive to the said event, each of the pulses in the said sequence being marked by a distinctive sign making it possible to situate it in time ($\Delta T_i$) in relation to the said event and by a code making it possible to identify each racer, and of a receiving device which is suitable for detecting the first interference-free pulse of the sequence and which, by considering a current time $t_h$ at the time of detection of the said code, makes it possible in turn to restore the value of the time $t_e$ at which the said event occurred and the identification of the racer to which the same time $t_e$ belongs.

2. A device according to claim 1, characterized in that the transmitting mechanism includes a pickup capable of producing a first electrical pulse triggered by the said event, a time base triggered by the said first electrical pulse, a counter able to count the signals given off by the time base in order to produce, during an initial predetermined interval ($T_E$), second electrical pulses separated from one another by second predetermined and equal intervals ($T_i$), a coder for assigning a distinctive sign to each of the second pulses, in particular a serial number, in accordance with the interval ($\Delta T_i$) separating them from the first pulse and for assigning to each of the said second pulses a code which responds to an addressing device and a transmitter for transmitting electromagnetic waves modulated by the signal given off by the said coder, and by the fact that the receiving mechanism entails a receiver proper for receiving the said electromagnetic waves, a decoder arranged to select the first of the said second pulses received from the receiver which is not marked by interference, assign to it an interval value ($\Delta T_i$) corresponding to the distinctive sign it bears, and determine the identification of the racer, a clock able to provide the time $t_h$ and a calculation unit to carry out a subtraction operation according to the equation $t_h - \Delta T_i = t_e$, where $t_e$ represents the time at which the said event occurred.

3. A device according to claim 2, characterized by the fact that the time base has a precision better than 100 seconds in 24 hours.

4. A device according to claim 2, characterized by the fact that the first predetermined interval ($T_E$) during which said second electrical pulses occur is one second in length and the predetermined and equal intervals ($T_i$) separating said second electrical pulses are 0.1 second in length.

5. A device according to claim 2, characterized by the fact that the time $t_h$ indicated by the clock is the time of day.

6. A method of deriving at a second station an indication of a time $t_e$ of occurrence of an event at a first station, said method comprising:

generating at the first station a sequence of pulses, the first pulse of the sequence being generated $T_i$ second after occurrence of the event and succeeding pulses of the sequence being generated $T_i$ second after the preceding pulse:

assigning a distinctive sign to each pulse of the sequence;

transmitting said pulses and their assigned distinctive signs to said second station through an environment which may interfere the transmission and cause the loss of one or more of said pulses;

detecting at said second station the first of said transmitted pulses which has not been lost during transmission;

determining, from the distinctive sign assigned to the detected pulse, the elapsed time $\Delta T_i$ which has elapsed since occurrence of said event;

generating at said second station a precise indication of a time $t_h$; and, subtracting the elapsed time $\Delta T_i$ from the time $t_h$ to obtain the time $t_e$ at which said event occurred.

7. A system for deriving at a second station an indication of a time $t_e$ of occurrence of an event at a first station, said system comprising:

a first station including, means for detecting occurrence of said event;

a source of clock pulses;

a counter;

gating means responsive to said detecting means and said source of clock pulses for applying said clock pulses to said counter, said counter responding to said clock pulses to produce a sequence of pulses separated from each other by an interval of time $t_i$;

encoder means for generating a distinctive sign for each pulse of said sequence;

transmitter means for transmitting said sequence of pulses and their distinctive signs through a medium in which interference may cause the loss of one or more of said pulses in said sequence;

a second station comprising means for receiving such of said transmitted sequence of pulses and distinctive signs as are not lost during transmission through said medium;

decoder means responsive to the first received pulse of said sequence for deriving from the distinctive sign for said first received pulse a value $\Delta T_i$ representing the elapsed time since occurrence of said event;

a precise clock for producing an indication of the present time $t_h$; and, means responsive to said precise clock and said decoder means for subtracting the value $\Delta T_i$ from the indication of time $t_h$ to obtain the indication of the time of occurrence $t_e$ of said event.

* * * * *